US007163139B2

(12) United States Patent
Marie et al.

(10) Patent No.: US 7,163,139 B2
(45) Date of Patent: Jan. 16, 2007

(54) CARTON AND CARTON BLANK

(75) Inventors: Philippe Marie, Coings (FR); John M Hepworth, Rugby (GB)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 10/914,393

(22) Filed: Aug. 9, 2004

(65) Prior Publication Data

US 2005/0061865 A1 Mar. 24, 2005

Related U.S. Application Data

(63) Continuation of application No. PCT/US03/04146, filed on Feb. 10, 2003.

(30) Foreign Application Priority Data

Feb. 8, 2002 (GB) ..... 0203005.4

(51) Int. Cl.
*B65D 17/32* (2006.01)
*B65D 5/20* (2006.01)

(52) U.S. Cl. ..... 229/237; 229/242; 229/243; 229/925

(58) Field of Classification Search ..... 229/236, 229/237, 240, 242, 243, 924, 925
See application file for complete search history.

(56) References Cited

U.S. PATENT DOCUMENTS 751,047 A 2/1904 Bircher
2,285,542 A 6/1942 Tasker
2,680,558 A * 6/1954 Mai ..... 229/237
2,967,010 A * 1/1961 Cuffey, Jr. et al. ..... 229/242
3,078,030 A 2/1963 Gorton
3,131,848 A * 5/1964 Floyd ..... 229/924
3,215,332 A 11/1965 Bess
3,295,743 A 1/1967 Redpath et al.
3,355,089 A * 11/1967 Champlin ..... 229/243
3,580,482 A 5/1971 Witte
3,684,156 A 8/1972 Fettinger et al.
3,708,104 A * 1/1973 Buttery ..... 229/237
4,008,849 A * 2/1977 Baber ..... 229/237
4,113,102 A 9/1978 Mueller
4,301,922 A 11/1981 Hamelin et al.
4,511,043 A * 4/1985 Roccaforte ..... 229/237
5,307,986 A * 5/1994 Schuster ..... 229/244
5,464,151 A 11/1995 Parker et al.
6,364,202 B1 * 4/2002 Zelley ..... 229/236

FOREIGN PATENT DOCUMENTS

DE 2 129 535 D1 12/1972
DE 3247958 A * 6/1984 ..... 229/240
FR 2445802 9/1978
GB 2 276 147 A 9/1994

* cited by examiner

*Primary Examiner*—Gary E. Elkins
(74) *Attorney, Agent, or Firm*—Tsugihiko Suzuki

(57) ABSTRACT

A carton and blank having a tear line comprising a plurality of perforations or short slits arranged in at least three rows. There is also provided a carton and blank for forming a carton having a wall provided with a tear open feature which comprises a tear initiating tab formed in the wall and at least three tear lines extending from the tear initiating tab toward the perimeter of the wall, wherein each tear line comprises a plurality of perforations or short slits arranged in at least three rows.

22 Claims, 5 Drawing Sheets

CARTON AND CARTON BLANK

This is a continuation of international application No. PCT/US03/04146, filed Feb. 10, 2003, which is hereby incorporated by reference.

BACKGROUND OF THE INVENTION

The invention relates to a carton or sleeve for accommodating one or more articles for example cans, bottles or the like formed from one or more blanks of paperboard or other suitable foldable sheet material and more particularly to a carton capable of being formed into a sealed compartment including a cover flap with mean for releasably fastening the cover flap to the carton.

The invention is particularly useful where it is desirable for cartons containing articles to be enclosed to protect the or each article.

One example of reclosable sleeves formed from one or more blanks of cardboard is found in U.S. Pat. No. 3,078,030, which illustrates a carton having integral hinged top that is reclosable. The top is provided by a front cover panel and a spacer panel secured to one side of the front cover panel to interfit with a mating upper portion of the front panel of a box. Fastening means is formed from a detached double layer portion of the front panel. However, the detached portion is attached to the inside surface of the cover flap resulting in a stepped non-flat front surface.

A second aspect of the invention is concerned with the provisions of a frangible connection for releasably fastening the cover flap. More particularly, a tear strip arrangement is disclosed.

There are several known types of tear line in common use, examples of which are illustrated in U.S. Pat. No. 2,28,552 or U.S. Pat. No. 3,355,089. However, one problem associated with known tear lines or strips is that the action of tearing is difficult to control. For example, the grain direction of the board or direction of tearing force will influence the tear direction.

To try to encourage tearing along a predetermined path tear lines are used.

A problem with known tear arrangements is that, in certain circumstances the tear may deviate from the desired path leading to an irregular tear line path or worse, deviation from the tear line completely which may result in destroying the integrity of the carton.

SUMMARY OF THE INVENTION

A first aspect of the invention provides a carton having a tear line comprising a plurality of perforations or short slits arranged in at least three rows Optionally, the perforations or slits of each row is offset the perforations or short slits of the next adjacent row.

Preferably, the perforations in a row are spaced by a distance in the range of about 1 mm to 5 mm. More preferably, each row is spaced from the next adjacent row by a distance of about 0.5 mm to 2.5 mm.

A second aspect of the invention provides a carton having a wall provided with a tear open feature which comprises a tear initiating means formed in the wall and at least three tear lines extending from the tear initiating means toward the perimeter of the wall, wherein each tear line comprises a plurality of perforations or short slits arranged in at least three rows.

The tear open feature may comprise four tear lines extending towards the four corners of the wall respectively.

Optionally, the tear initiating means comprises a push tab struck from the wall.

A third aspect of the invention, in a carton formed from paperboard or other sheet material of like function, a tear structure which defines a join between two adjacent panels, means to grasp a panel to be torn away defined, at least in part, by said tear structure so that it can be displaced out of the plane it occupies at rest and fold lines disposed between said means and said tear structure to enhance the amount by which said tear away panel can be displaced so that shear forces exerted on the tear structure are sufficient to cause tearing at the tear structure whereby the tear away panel can be removed from the carton.

According to an optional feature of the third aspect, the tear away panel provides access to the carton contents when removed.

Preferably, the tear away panel is a top panel of the carton and wherein the tear structure extends around the periphery of that panel and wherein said means for grasping the panel is disposed remote from its periphery, said fold lines extending from said means in a multiplicity of directions to meet said tear structure at a plurality of locations.

More preferably, said tear structure comprises at least two adjacent perforate lines wherein the perforations in one of said lines are disposed intermediate the perforations in the next adjacent line and wherein the spacing between said adjacent lines is no greater than the spacing between the perforations of either one of them.

A fourth aspect of the invention provides a blank for forming a carton having a tear line comprising a plurality of perforations or short slits arranged in at least three rows. In the blank, the perforations or slits of each row is offset the perforations or short slits of the next adjacent row. Preferably, the perforations in a row are spaced by a distance in the range of about 1 mm to 5 mm. More preferably, each row is spaced from the next adjacent row by a distance of about 0.5 mm to 2.5 mm.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
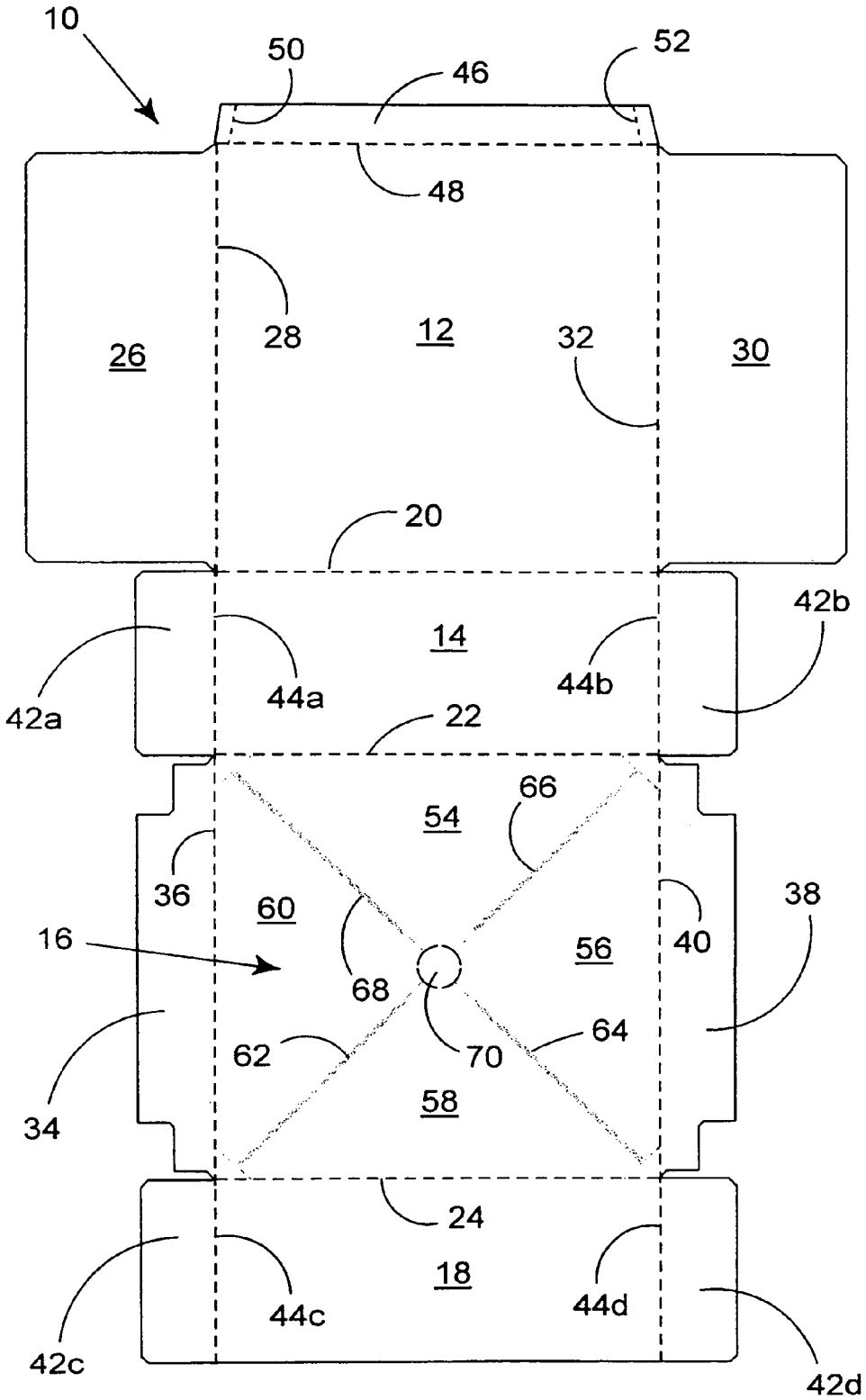
FIG. 1 is a plan view of a blank for forming a carton incorporating the tear line arrangement according to a first embodiment of the invention.

Referring first to FIG. 1, there is shown a unitary blank 10 for forming a carton made from paperboard or similar foldable sheet material. The carton is adapted to hold one or more articles. In this embodiment the blank 10 comprises a base panel 12, first side wall panels 14, top panel 16 and second side wall panel 18 hingedly connected together in series along fold lines 20, 22 and 24 respectively.

There may further comprise opposed end wall panels 26, 30 hingedly connected to the opposed end edges of base panel 12 along fold lines 28 and 32 respectively. In this embodiment, the base panel is substantially square although it is envisaged that other shapes of the base panel and/or sleeve can be adopted according to the shape and/or size of the article(s) to be contained.

In those embodiments with end wall panels 26 and 28, there further comprises opposed end flaps 34 and 38 hingedly connected to opposed edges of top panel 16 along fold lines 36 and 40.

In this embodiment, the support flaps are provided along the longitudinal edges of the side wall panel 14 and 18 respectively. As shown in FIG. 1, there comprises side flaps 42*a* and 42*b* hingedly connected to the opposed edges of side panel 14 along fold lines 44*a* and 44*b*. Similarly, end flaps 42*c* and 42*d* are hingedly connected to the opposed edges of second side wall panel 18 along fold lines 44*c* and 44*d*.

There further comprises a securing flap 46 hingedly connected to base panel along fold line 48, to secure the opposite ends of the blank together. The securing flap 46 may be provided with fold lines 50 and 52.

One aspect of the invention provides a one or more detachable cover flaps formed in the top wall panel 16. In this embodiment there comprises four cover flaps 54, 56, 58 and 60 provided to cover the top surface of the carton. The cover flaps are hingedly connected to the carton both along fold lines 22, 40, 24 and 36 respectively.

The cover flaps are frangibly interconnected together by frangible lines: so in this embodiment, cover panel 54 is frangibly connected to cover panels 56 and 60 along frangible lines 66 and 68. Likewise, cover panel 58 is frangibly connected to cover panels 60 and 56 along frangible lines 62 and 64.

The cover flaps are, in this embodiment, triangular in shape although other polygonal shaped are envisaged without departing from the scope of invention. In order to assist in separating adjacent cover flaps, there further comprises a push tab 70, which is detachably connected to the top panel. In FIG. 1 the tab 70 is centrally positioned at the point the frangible lines 62, 64, 66, 68 interconnect.

Figure 4:
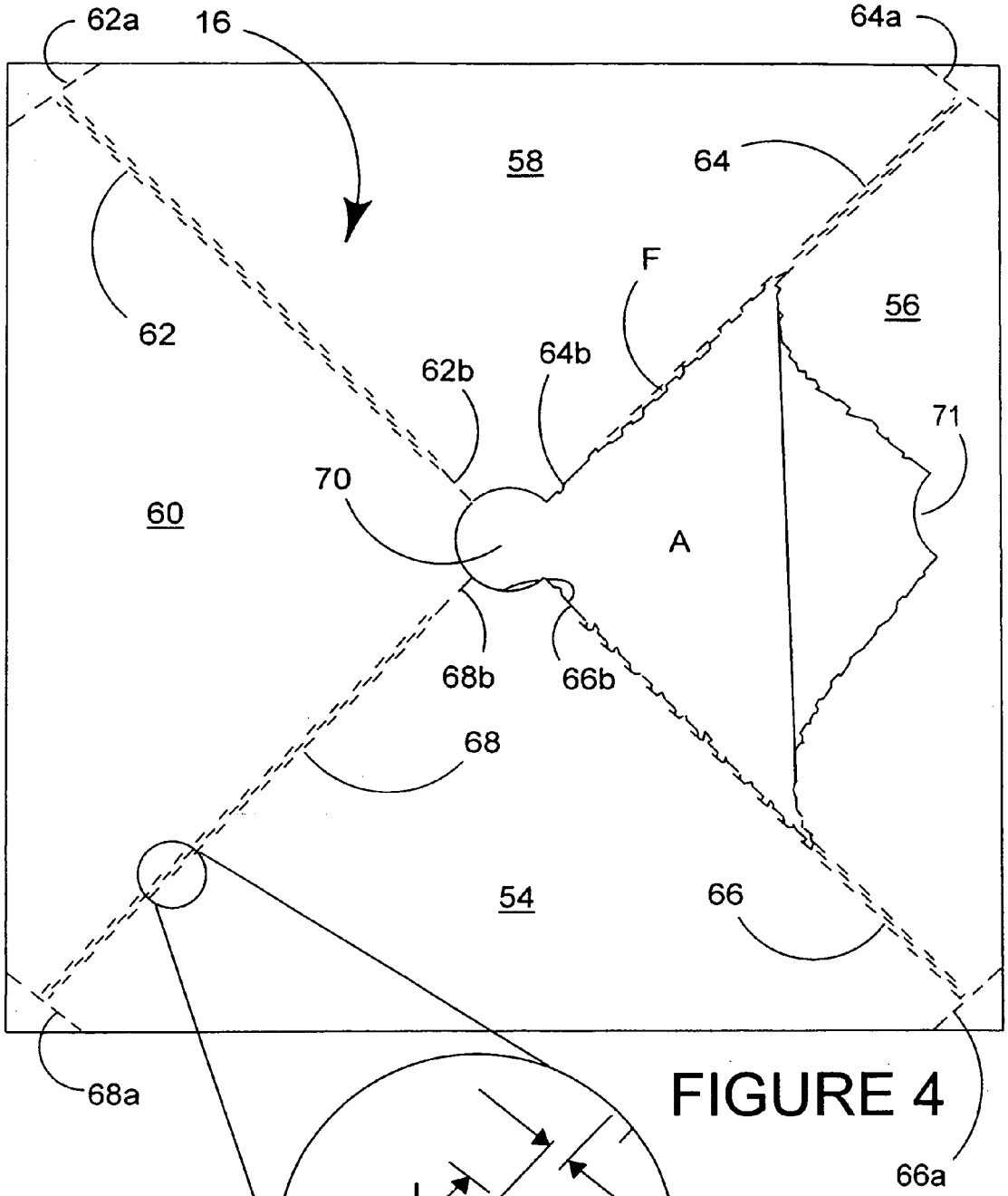

At each of the opposing ends of frangible lines 62, 64, 66 and 68, there is provided a fold line 62*a*, 62*b*; 64*a*, 64*b*; 66*a*, 66*b*; 68*a*, 68*b* bisecting the frangible lines shown in FIG. 4. The fold lines prevent the tearing from going beyond the ends of the frangible lines, by dissipating the tearing forces.

Figure 4A:
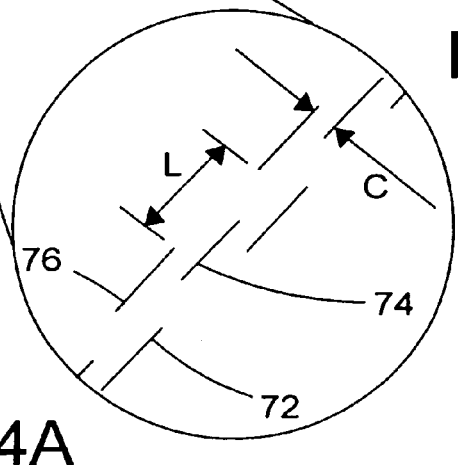
FIG. 4*a* is an enlarged view of the tear strip feature.

Another aspect of the invention relates to the structure of the frangible lines 62, 64, 66 and 68. FIGS. 4 and 4A illustrate the preferred embodiment of tear line 68 which are formed from three or more individual rows 72, 74 76 comprising a plurality of perforations or short slits. In each row, a perforation is spaced from the next adjacent perforation by a distance L. The distance L will vary according to particular tear characteristics, although it has been found that a usable range of distance L is between approximately 1 and 5 mm. Each row 72, 74, 76 is also spaced from the next adjacent row by a distance C. The distance C will vary according to particular tear characteristics required, although it has been found that a usable range of distance C is between approximately 0.5 and 2.5 mm.

Each row of perforations is offset the next row so that the perforations appear to have a "stair" shape as shown in FIG. 4A.

In use, the tear line 68 has been found to be more effective than a tear strip with one or two rows of slits because the central row of perforations 74 transmits the tear along its length—the force of the tear passes through this central line. The shearing forces are then applied across one side or the other side of the central row 74 to tear the space C between the central row 74 and the outer rows 72 and 76, as the tear moves along the tear line.

Thus, it far easier to control the direction of tearing by allowing a degree of flexibility as to where tear takes place within the outer rows.

One advantage of this type of tear line is that it is possible to produce a rounded tear strip, for example to follow the shape of the logo on the advertising indicia printed onto the board.

It is envisaged that any of the embodiments of the carton of the present invention can be formed by a series of sequential folding and gluing operations, which can be formed in a straight-line machine so that the carton is not required to be rotated or inverted to complete its construction. The folding process is not limited to that described below and can be altered according to particular manufacturing or user requirements. For example, the carton could be part constructed whereby side panel 18 and securing flap 50 are secured together to form a tubular structure before loading it with articles.

The base wall panel 12, opposed side wall panels 14, 18 and top panels 16 are folded out of alignment along fold lines 20, 22 and 24 and are folded into a tubular structure and securing flap 46 is secured to side panels 18 by glue or other means known in the art.

The article(s) is loaded into the carton by known packaging means.

Figure 2:
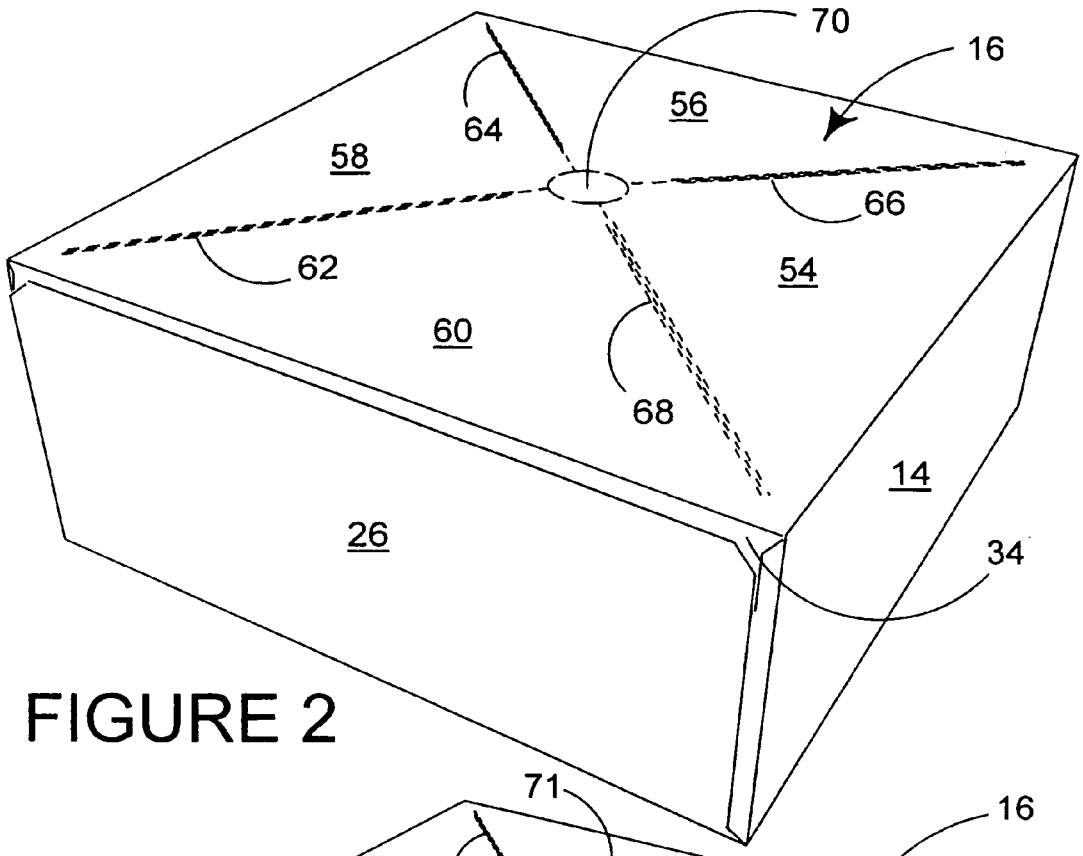
FIG. 2 is a perspective view of the carton formed from the blank illustrated in FIG. 1 in a set-up and loaded condition.

The support flaps 42 are folded inwardly along fold lines 44 and the opposing ends are constructed by folding end wall panels 26 and 30 upwardly along fold lines 28 and 32 respectively. Likewise the end flaps 34 and 38 are folded downwardly along fold lines 36 and 40 and the outer face of the end flaps 34 and 38 are secured to the inner face of end wall panels 26 and 30 by glue or other means know in the art. Thus the carton is in a set up and loaded condition as shown in FIG. 2.

Figure 3:
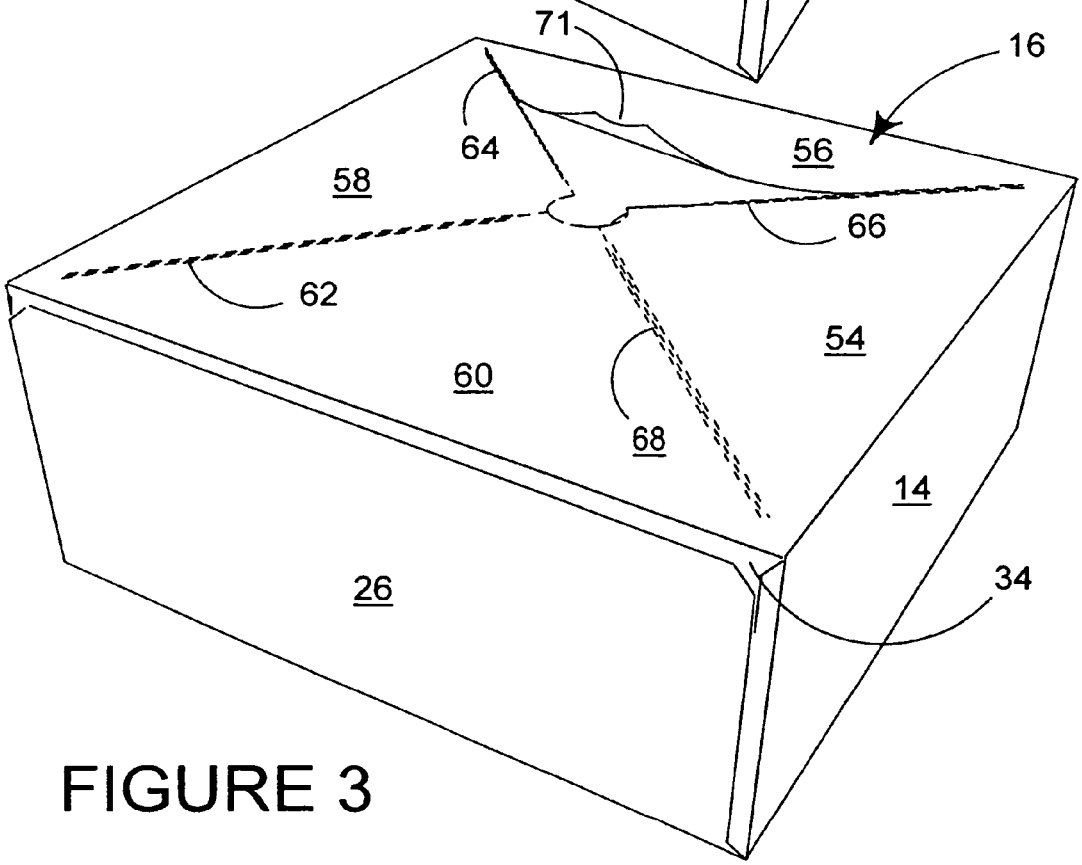
FIGS. 3 and 4 illustrate the carton with the cover flap partially torn open.

In order to gain access to the interior of the carton the push tab 70 is depressed inwardly by the user to reveal an edge 71 which is gripped by the user to tear one of the cover flaps 56 in an upward and outward direction as shown in FIG. 3. As the cover flap 56 continues to be pulled outwardly the tear lines 64 and 66 tear to reveal an access aperture A. The tearing process corresponds to that described above and illustrated in FIGS. 4 and 4A.

Figure 5:
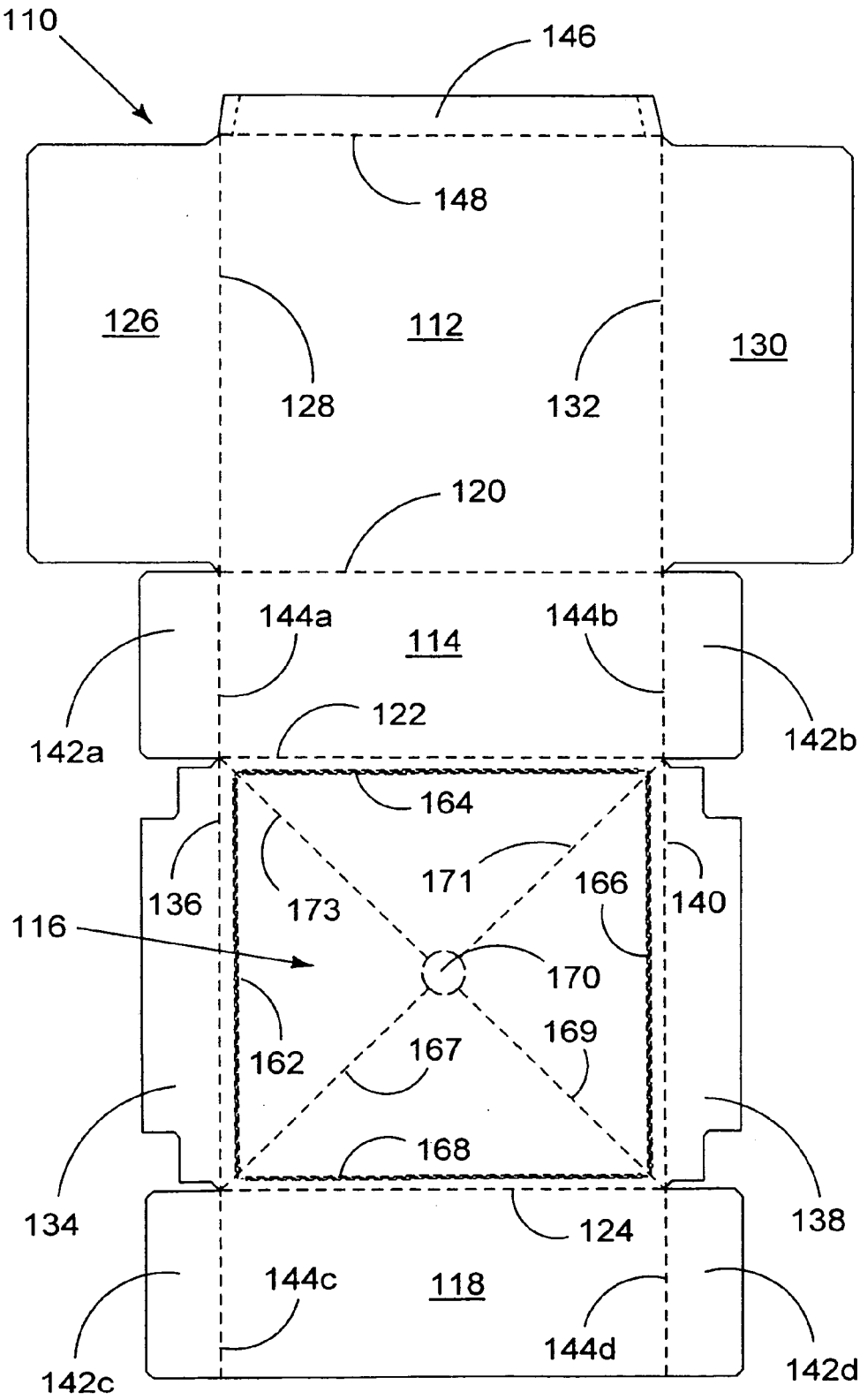
FIG. 5 illustrates a blank according to a second embodiment of the invention.
Figure 6:
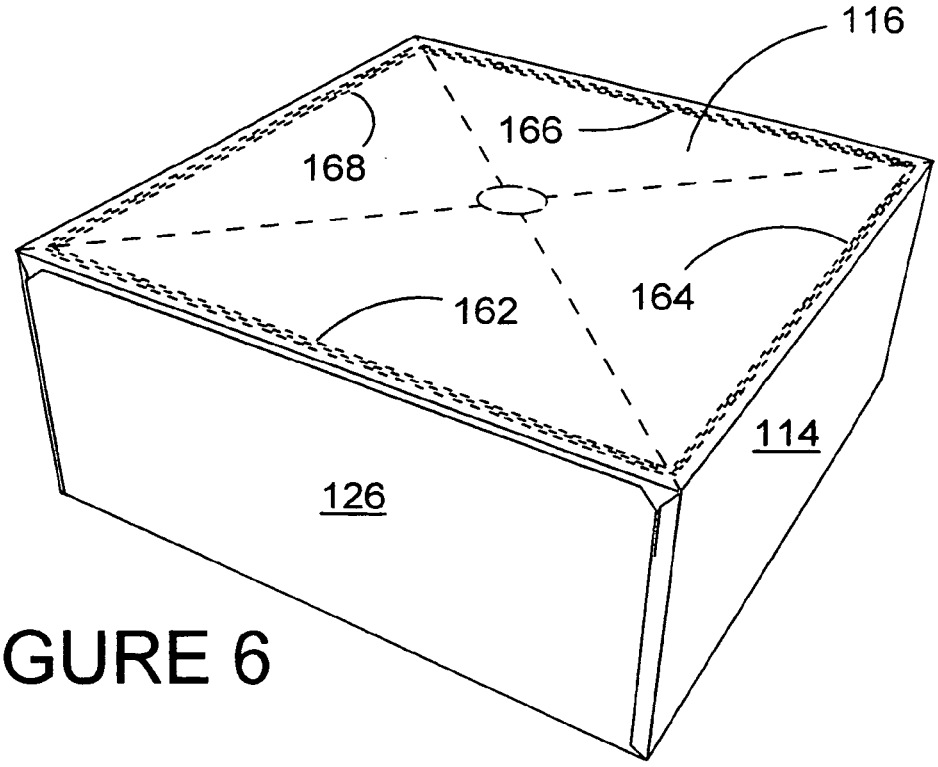
FIG. 6 illustrates a perspective view of the carton formed from the blank of FIG. 5 in a set-up and loaded condition.
Figure 7:
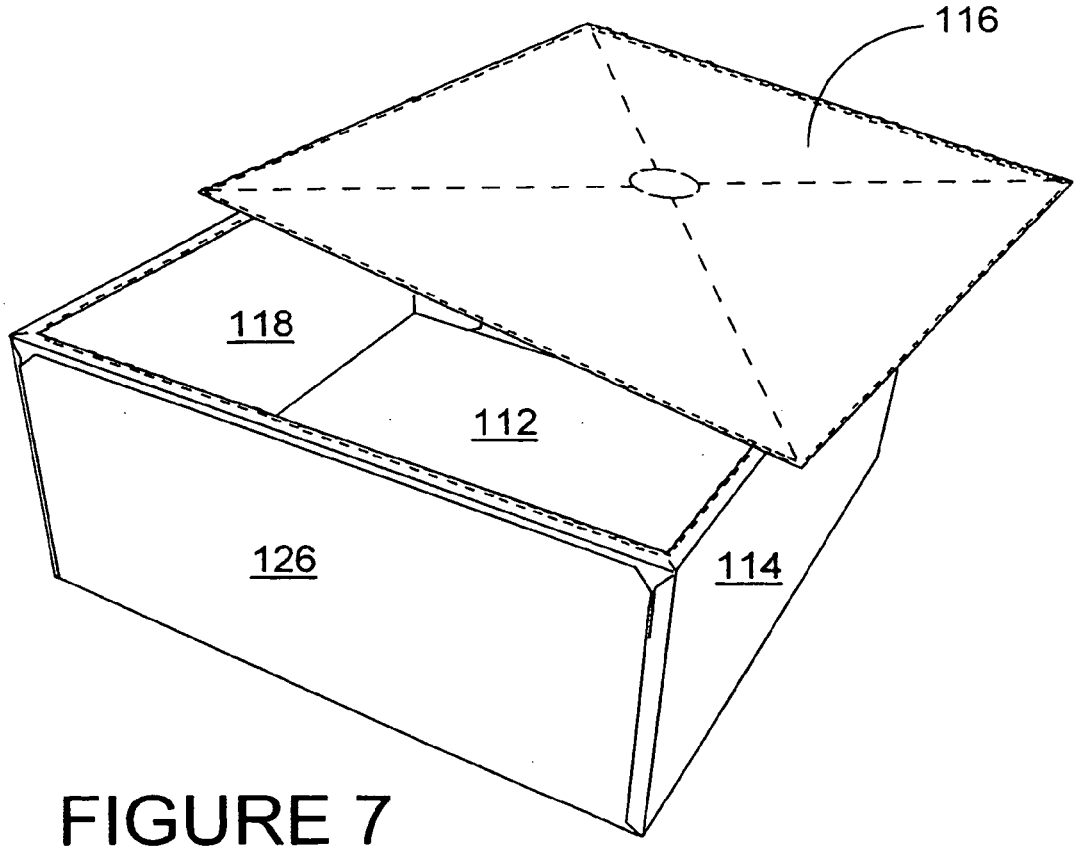
FIG. 7 illustrates the carton of FIG. 6 with the cover panel fully torn open.

A second embodiment is illustrated in FIGS. 5, 6 and 7, which embodiment shares many identical panels and fold lines so like parts have been designated by the same reference numerals with the prefix '1'. Therefore, only the differences will be described in any greater detail.

The carton blank 110 is provided with a unitary cover panel 116 hingedly interconnecting side wall panels 114 and 118. The unitary cover panel 116 is substantially square in shape being defined along its edges by tear lines 162, 164, 166 and 168. In some embodiments, there further comprises one or more fold lines 167, 169, 171, 173 to direct the lifting forces, described in more detail below. A push tab 170 is provided in the central region of the cover panel 116, although in other embodiments it could be positioned close to one corner of the cover panel to help with starting the tearing off from that corner.

The construction of the second embodiment is identical to the first embodiment as shown in FIG. 6, so shall not be described in any greater detail.

In order to remove the cover panel, the push tab 170 is depressed to reveal an aperture. Thereafter the user inserts a finger into the aperture and pulls the cover flap 116 which is then detached from the remaining panels of the carton by tearing along tear lines 162, 164, 166 and 168, as shown in FIG. 7. One advantage of this arrangement is that the cover flap is removed from the carton with a single pulling action.

Beneficially the embodiments of the invention hereinbefore described provided a structure that is sufficiently strong to retain articles and to provide an integral sleeve or enclosed carton. The use of paperboard material provides an environmentally alternative to cartons made from plastic material and the sleeves made from paperboard can include printed matter for marketing purposes.

It will be recognized that as used herein, the terms "top", "bottom", "side", "end", "upper" and "lower" with respect to the panels of the carton (or carton blank) are relative terms, and that the carton (formed from the blank) may be re-oriented as necessary or as desired. It will be further recognized that rather than the bottom wall being formed from the interlocked panels, the carton blank may be rearranged whereby some other wall such as a top wall or a side wall is formed from the interlocked panels.

Any reference to hinged connection should not be construed as necessarily referring to a single fold line only: indeed it is envisaged that hinged connection can be formed from one or more of one of the following, a score line, a frangible line or a fold line, without departing from the scope of invention.

The invention and its preferred embodiment relate to a carton or a sleeve which is shaped to provide satisfactory rigidity to hold items such as information discs for example floppy or zip discs or foodstuff with a degree of flexibility. The shape of the blank minimizes the amount of paperboard required for the carton. The carton can be constructed from a flat collapsed condition to position of use and/or loaded by hand or automatic machinery. It is anticipated the invention can be modified without departing from the scope of the invention: for example, side and end panels can be increased in height or width to provide a carton to receive one or more articles of different shapes and/or sizes. Additionally, the tear lines shown in the various embodiments can be applied to other known carton types, for example a fully enclosed carton or wraparound cartons for beverage containers or for foodstuffs, without departing from the scope of invention.

What is claimed is:

1. A carton having a tear line comprising a plurality of substantially straight short slits arranged in at least three rows including a pair of opposed exterior rows and an intermediate row, wherein the short slits of each of said at least three rows are offset from and substantially parallel to the short slits of the next adjacent row, wherein the short slits of one of the exterior rows are offset from the short slits of the second next row to said one of the exterior rows, wherein the slits in said each of said at least three rows are spaced by a distance of L, wherein said each of said at least three rows is spaced from the next adjacent row by a distance of C, and wherein L is substantially greater than C.

2. A carton as claimed in claim 1 wherein L is in the range of about 1 mm to 5 mm.

3. A carton as claimed in claim 1 wherein C is about 0.5 mm to 2.5 mm.

4. A carton as claimed in claim 1 wherein the short slits of each of the exterior rows are offset from the short slits of the second next row to said each of the exterior rows.

5. A carton having a wail provided with a tear open feature which comprises a tear initiating means formed in the wall and at least three tear lines extending from the tear initiating means toward the perimeter of the wall, wherein each tear line comprises a plurality of short slits arranged in at least three rows including a pair of opposed exterior rows and an intermediate row, wherein the slits of each of said at least three rows are offset from the slits of the next adjacent row, and wherein the short slits of one of the exterior rows are offset from the short slits of the second next row to said one of the exterior rows, wherein the slits in said each of said at least three rows are spaced by a distance of L, wherein said each of said at least three rows is spaced from the next adjacent row by a distance of C, and wherein L is substantially greater than C.

6. A carton as claimed in claim 5 wherein the tear open feature comprises four tear lines extending towards four corners of the wall respectively.

7. A carton as claimed in claim 5 wherein the tear initiating means comprises a push tab struck from the wall.

8. A carton formed from sheet material, comprising a tear structure which defines a join between two adjacent panels, grasping means to grasp at least one of the panels to be displaced, said at least one of the panels being defined, at least in part, by said tear structure so that said at least one of the panels can be displaced out of a plane which said at least one of the panels occupies at rest and fold lines disposed between said grasping means and said tear structure to enhance the amount by which said at least one of the panels can be displaced so that shear forces exerted on the tear structure are sufficient to cause tearing at the tear structure.

9. A carton according to claim 8 wherein said at least one of the panels provides access to carton contents when displaced.

10. A carton according to claim 8 wherein said at least one of the panels is a top panel of the carton, wherein the tear structure extends around the periphery of the top panel and wherein said grasping means is disposed remote from the periphery of the top panel, said fold lines extending from said grasping means in a multiplicity of directions to meet said tear structure at a plurality of locations.

11. A carton according to claim 8 wherein said tear structure comprises a tear line that comprises at least two adjacent rows of perforations wherein the perforations in one of said rows are disposed intermediate the perforations in the next adjacent row and wherein the spacing between said adjacent rows is no greater than the spacing between the perforations of any one of the rows.

12. A blank for forming a carton having a tear line, said tear line comprising a plurality of substantially straight short slits arranged in at least three rows including a pair of opposed exterior row and an intermediate row, wherein the slits of each of said at least three rows are offset from and substantially parallel to the slits of the next adjacent row, and wherein the short slits of one of the exterior rows are offset from the short slits of the second next row to said one of the exterior rows, wherein the slits in said each of said at least three rows are spaced by a distance of L, wherein said each of said at least three rows is spaced from the next adjacent row by a distance of C, and wherein L is substantially greater than C.

13. A blank as claimed in claim 12 wherein L is in the range of about 1 mm to 5 mm.

14. A blank as claimed in claim 12 wherein C is about 0.5 mm to 2.5 mm.

15. A carton having a tear line, said tear line comprising a plurality of substantially straight elongate perforations arranged in at least three rows including a pair of opposed exterior rows and an intermediate row, wherein the perforations of each of said at least three rows are offset from and substantially parallel to the perforations of the next adjacent row, and wherein the perforations of one of the exterior rows are offset from the perforations of the second next row to said one of the exterior rows, wherein the slits in said each of said at least three rows are spaced by a distance of L, wherein said each of said at least three rows is spaced from the next adjacent row by a distance of C, and wherein L is substantially greater than C.

16. A carton as claimed in claim 15 wherein L is in the range of about 1 mm to 5 mm.

17. A carton as claimed in claim 15 wherein C is about 0.5 mm to 2.5 mm.

18. A carton having a wall provided with a tear open feature which comprises a tear initiating means formed in the wall and at least three tear lines extending from the tear initiating means toward the perimeter of the wall, wherein each tear line comprises a plurality of perforations arranged in at least three rows including a pair of opposed exterior rows and an intermediate row, wherein the perforations of each of said at least three rows are offset from the perforations of the next adjacent row, and wherein the perforations of one of the exterior rows are offset from the perforations of the second next row to said one of the exterior rows, wherein the perforation in said each of said at least three rows are spaced by a distance of L, wherein said each of said at least three rows is spaced from the next adjacent row by a distance of C, and wherein L is substantially greater than C.

19. A carton as claimed in claim 18 wherein the tear open feature comprises four tear lines extending towards four corners of the wall respectively.

20. A carton as claimed in claim 18 wherein the tear initiating means comprises a push tab struck from the wall.

21. A carton having a tear line comprising a plurality of substantially straight short slits arranged in three rows including a pair of opposed exterior rows and an intermediate row, wherein the short slits of one of said exterior rows are longitudinally offset from the short slits of said intermediate row and from the short slits of the other of said exterior rows such that any notional line perpendicular to said intermediate row intersects no more than two of said plurality of the short slits and wherein the short slits of said one of said exterior rows arc substantially parallel to the short slits of said intermediate row.

22. A carton as claimed in claim 21 wherein the slits in said each of said three rows are spaced by a distance of L, wherein said each of said three rows is spaced from the next adjacent row by a distance of C, and wherein L is substantially greater than C.

* * * * *